US011286130B2

(12) United States Patent
Marciano

(10) Patent No.: US 11,286,130 B2
(45) Date of Patent: Mar. 29, 2022

(54) REDIRECTION AND SAMPLING DEVICE AND METHOD FOR A PLATE-SHAPED ELEMENT

(71) Applicant: BOBST MEX SA, Mex (CH)

(72) Inventor: Pascal Marciano, Bussigny (CH)

(73) Assignee: BOBST MEX SA, Mex (CH)

( * ) Notice: Subject to any disclaimer, the term of this patent is extended or adjusted under 35 U.S.C. 154(b) by 222 days.

(21) Appl. No.: 16/339,319

(22) PCT Filed: Oct. 5, 2017

(86) PCT No.: PCT/EP2017/025299
§ 371 (c)(1),
(2) Date: Apr. 3, 2019

(87) PCT Pub. No.: WO2018/072886
PCT Pub. Date: Apr. 26, 2018

(65) Prior Publication Data

US 2019/0233238 A1 Aug. 1, 2019

(30) Foreign Application Priority Data

Oct. 18, 2016 (EP) ..... 16020404

(51) Int. Cl.
*B65H 29/58* (2006.01)
*B65H 29/24* (2006.01)

(52) U.S. Cl.
CPC ..... *B65H 29/585* (2013.01); *B65H 29/242* (2013.01); *B65H 2404/63* (2013.01); *B65H 2701/1764* (2013.01)

(58) Field of Classification Search
CPC .... B65H 29/585; B65H 29/62; B65H 29/242; B65H 2404/63
See application file for complete search history.

(56) References Cited

U.S. PATENT DOCUMENTS 3,955,812 A * 5/1976 Suda ..... B07C 1/04 271/286
5,172,909 A * 12/1992 Ricciardi ..... B07C 3/065 271/176

(Continued)

FOREIGN PATENT DOCUMENTS

CN 1561297 A 1/2005
CN 201125100 Y 10/2008

(Continued)

OTHER PUBLICATIONS

International Search Report issued in related PCT/EP2017/025299, dated Dec. 20, 2017 (4 pages).

(Continued)

*Primary Examiner* — Patrick Cicchino
(74) *Attorney, Agent, or Firm* — Bookoff McAndrews, PLLC

(57) ABSTRACT

A device (110) for sampling sheet elements (20) in a sorting unit (100) comprises:

transport means (111, 112) defining a plane (P0) and able to move (A) a sheet element (20) longitudinally upstream to downstream, an axis (R1) situated at the level of the transport means (111, 112) and extending transversely, a diversion part (113) rotatable about the axis (R1) and having at least one end (114) so that during the rotation of the diversion part (113) through a first angular sector (S1) the horizontal projection of the end (114) remains below the plane (P0) and during the rotation through a second angular sector (S2) complementary to the first angular sector the horizontal projection of the end (114) moves above the plane (P0) so as to divert a sheet element (20) in a direction different from the plane (P0) and thus to sample the sheet element (20).

19 Claims, 4 Drawing Sheets

(56) References Cited

U.S. PATENT DOCUMENTS

| | | | | |
|---|---|---|---|---|
| 5,702,100 | A * | 12/1997 | Novick | B65H 29/40 271/187 |
| 6,176,485 | B1 * | 1/2001 | Wingate | B65H 29/12 271/303 |
| 9,114,432 | B2 * | 8/2015 | Mori | B07C 5/00 |
| 9,724,246 | B2 * | 8/2017 | Wada | B65H 29/12 |
| 2013/0001042 | A1 * | 1/2013 | Yamamoto | B65H 29/56 198/367.1 |
| 2020/0140221 | A1 * | 5/2020 | Talken | F16K 31/046 |

FOREIGN PATENT DOCUMENTS

| | | | |
|---|---|---|---|
| CN | 102177080 | A | 9/2011 |
| CN | 202369118 | U | 8/2012 |
| CN | 103538924 | A | 1/2014 |
| CN | 204096607 | U | 1/2015 |
| CN | 104670963 | A | 6/2015 |
| CN | 105228934 | A | 1/2016 |
| EP | 2 213 449 | A1 | 8/2010 |
| EP | 2 316 766 | A2 | 5/2011 |
| EP | 2 623 305 | A1 | 8/2013 |
| JP | S43-018060 | B | 7/1968 |
| JP | H03-245911 | A | 11/1991 |
| JP | H07237803 | A | 9/1995 |
| TW | M411424 | U | 9/2011 |
| WO | 2009041167 | A1 | 4/2009 |

OTHER PUBLICATIONS

Office Action from Korean Intellectual Property Office in related Korean Patent Application No. 10-2019-7013741, dated Sep. 24, 2020 (5 pages).

* cited by examiner

REDIRECTION AND SAMPLING DEVICE AND METHOD FOR A PLATE-SHAPED ELEMENT

CROSS-REFERENCE TO RELATED APPLICATION(S)

This application is a National Stage under 35 U.S.C. § 371 of International Application No. PCT/EP2017/025299, filed on Oct. 5, 2017, which claims priority to European Patent Application No. 16020404.6, filed Oct. 18, 2016, the contents of all of which are incorporated by reference in their entirety.

The present invention concerns a sampling device that effects the diversion of a sheet element serving as a sample taken up in order to move it away from the normal processing circuit while the sheet elements are flowing continuously at the outlet of a processing machine. The sample taken is used for example for its inspection and/or rejection. The invention also relates to a diversion and sampling method for such sheet elements.

Machines for processing sheet elements are used in the field of the fabrication of packaging and notably packaging manufactured from precut sheets or strips, notably paper, plastic or cardboard sheet elements, whether flat or corrugated. These may be machines that effect some processing of these sheet elements, for example cutting, creasing, embossing and printing.

PRIOR ART

In the prior art machines this sampling is effected by stopping the machine to take by hand a sheet element forming the sample. In other cases, systematic and continuous inspection of each individual sheet element is effected when it passes through a module dedicated to inspection, for example visual inspection. This entails taking at least one sheet element forming a sample away from the normal processing circuit, either on demand or cyclically.

Such diversion from the normal processing circuit is notably employed downstream of a printing machine in the case of printing effected on the upper face of the sheet element and without contact with the upper face of the sheet element in order not to damage that upper face. Such diversion from the normal processing circuit can also be effected at some other location of the normal processing circuit to discard the non-conforming sheet element or elements.

SUMMARY OF THE INVENTION

An object of the present invention is to propose a sampling device and a sampling and diversion method for the transfer of a sheet element.

Another object of the invention is to provide a diversion method and a sampling device enabling the continuous advance of the sheet elements without slowing the speed of advance of the sheet elements in order to continue the normal processing steps for the sheet elements that are not diverted.

Another object of the present invention is to enable the diversion to be effected either on demand or in accordance with a programmed frequency. The change of destination of the diversion can for example be brought about after only one cut-out has been diverted and before a series of sheet elements have been diverted. This can also be effected after a first series of sheet elements is diverted for sampling and before another series of sheet elements is not diverted.

To this end, the aim is to make it possible to modify the destination of the sampling device rapidly and accurately in order not to impede the correct operation of the machine for processing the sheet elements.

According to the invention, a sampling device for sampling sheet elements in a sorting unit comprises:

- transport means, the transport means defining a transport plane and the transport means being able to move a sheet element longitudinally upstream to downstream,
- an axis situated at the level of the transport means and extending transversely,
- a diversion part rotatable about the axis and having at least one end so that during the rotation of the diversion part through a first angular sector the horizontal projection of the end remains below the plane and during the rotation through a second angular sector complementary to the first angular sector the horizontal projection of the end moves above the plane so as to divert a sheet element in a direction different from the plane and thus to sample the sheet element.

The sheet element moving on the transport means is diverted by a rotation movement of a diversion part. The sheet element can follow the complete path of the transport means and then follow the path situated in line therewith, notably for normal processing of the sheet element, or be diverted from the path of the transport means to remove it for sampling.

This solution has the particular advantage compared to the prior art of not having to stop or even to slow down the machine for processing the sheet elements in order to sample and/or inspect one or more sheet elements. The rate of processing the sheet elements is therefore unchanged and the number of successive sheet elements diverted or not diverted can be distributed as required.

The present invention further concerns a sorting unit comprising a sampling device as described and claimed, an outlet conveyor and a device for evacuating the sampled sheet elements, the entry of the evacuation device being disposed upstream of and above the entry of the outlet conveyor.

A sorting unit of this kind makes it possible to effect a different selection of the sheet elements at the outlet of the processing machine according to whether the sheet element enters the branch of the sampling device and the evacuation device or the branch of the outlet conveyor.

The present invention also relates to a machine for processing sheet elements equipped with a sorting unit as described and claimed.

The present invention further relates to a method of sampling and of diversion of the route of a sheet element at the outlet of a processing machine. The method comprises the steps consisting in:

- transporting continuously upstream to downstream a sheet element disposed in a transport plane;
- turning a diversion part rotatable about a transverse axis;
- bringing into contact and supporting a lower face of the front zone of the sheet element during the transport of the sheet element by a first end of the diversion part projecting out of the transport plane;
- inclining upwards the front zone of the sheet element;
- stopping the rotation of the diversion part;
- engaging the front zone of the sheet element on an evacuation device and transporting the sheet element until the rear portion of the sheet element passes over the first end; and resuming the rotation of the diversion part until the horizontal projection of the first end is below the plane before another sheet element comes into vertical alignment with the first end.

Such a diversion method can be used when the sheet elements arrive continuously one after the other on the transport means.

BRIEF DESCRIPTION OF THE DRAWINGS

Embodiments of the invention are indicated in the description illustrated by the appended figures in which.

The longitudinal direction is defined relative to the direction in which the sheet elements are transported. The transverse direction is defined as being the direction orthogonal to the longitudinal direction and in the plane in which the sheet elements are transported. Upstream, respectively downstream, is defined as being a rear position, respectively front position, relative to the direction in which the sheet element is transported.

DETAILED DESCRIPTION OF PREFERRED EMBODIMENTS

Figure 1:
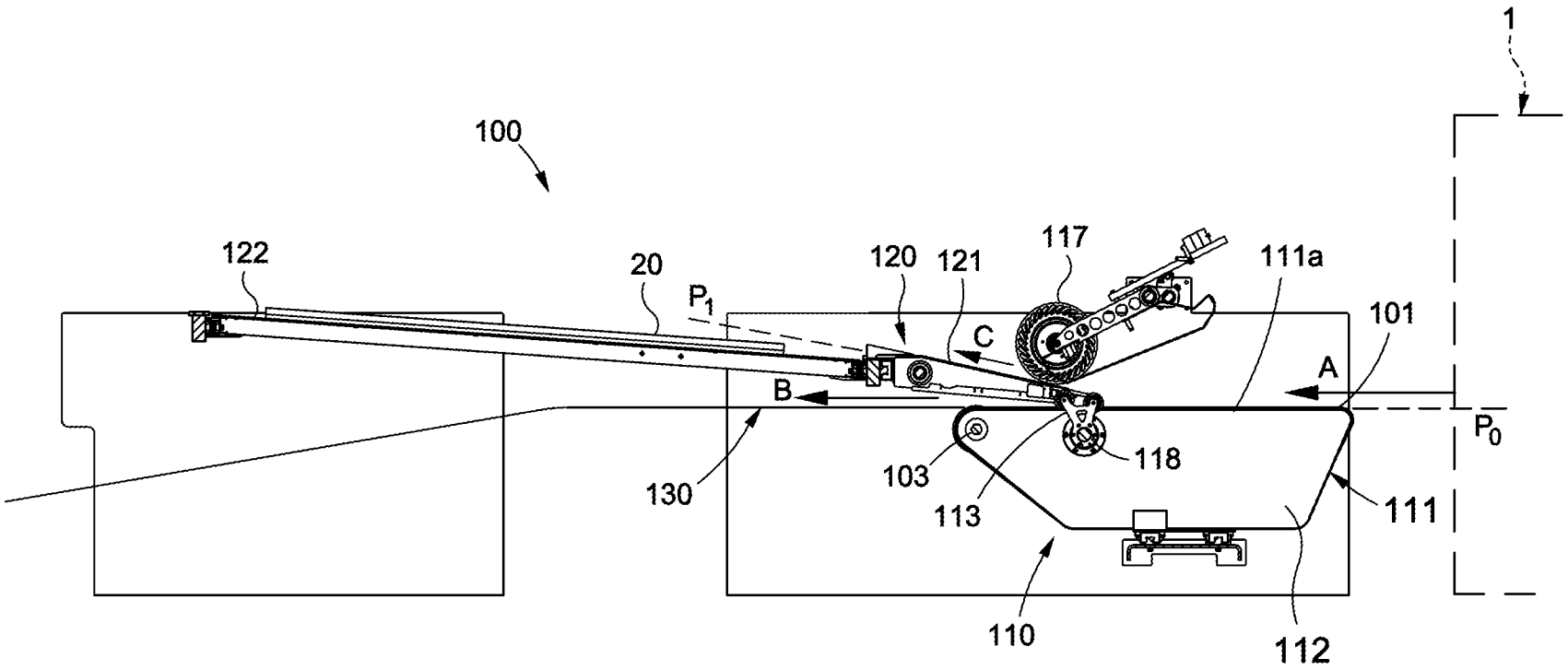
FIG. 1 shows a sorting unit including a device according to the invention for sampling sheet elements.

The sorting unit 100 shown in FIG. 1 forms an assembly disposed at the outlet from a machine for processing sheet elements 1. Such a sorting unit 100 is advantageously disposed downstream of a machine for printing sheet elements. The sheet element 20 advances upstream to downstream in the processing machine 1 and in the sorting unit 100, in the direction of the arrow A, i.e. from right to left in the Figures.

In FIG. 1, the sorting unit 100 comprises from upstream to downstream an entry 101, a sampling device 110 according to the invention, an evacuation device 120 and an outlet conveyor 130. In this embodiment the circuit for normal processing of the sheet elements that do not serve as samples and that are not rejected passes through the entry 101, the sampling device 110 in an inactive position and the outlet conveyor 130.

The sampling device 110 according to the invention enables the transfer (arrow B) of a sheet element 20 from the entry 101 of the sorting unit 100 to the normal processing circuit, i.e. to the outlet conveyor 130. The sampling device 110 according to the invention enables the transfer (arrow C) of a sheet element 20 or of a plurality of successive sheet elements from the entry 101 of the sorting unit 100 to the diversion of the sheet element or elements toward the evacuation device 120. The evacuation device 120 is situated above the outlet conveyor 130.

Figure 2:
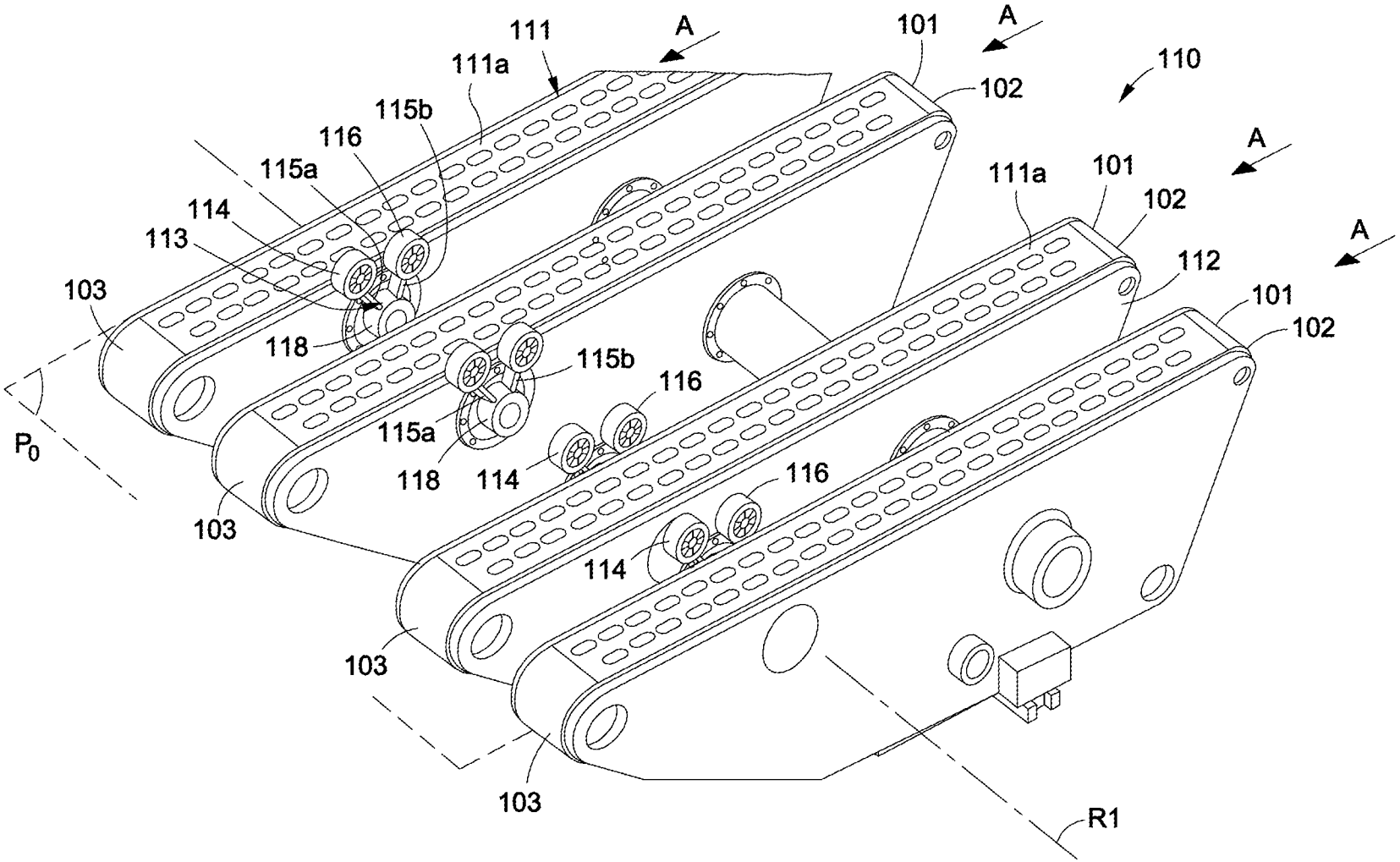
FIG. 2 is a perspective view of the sampling device from FIG. 1.
Figure 3:
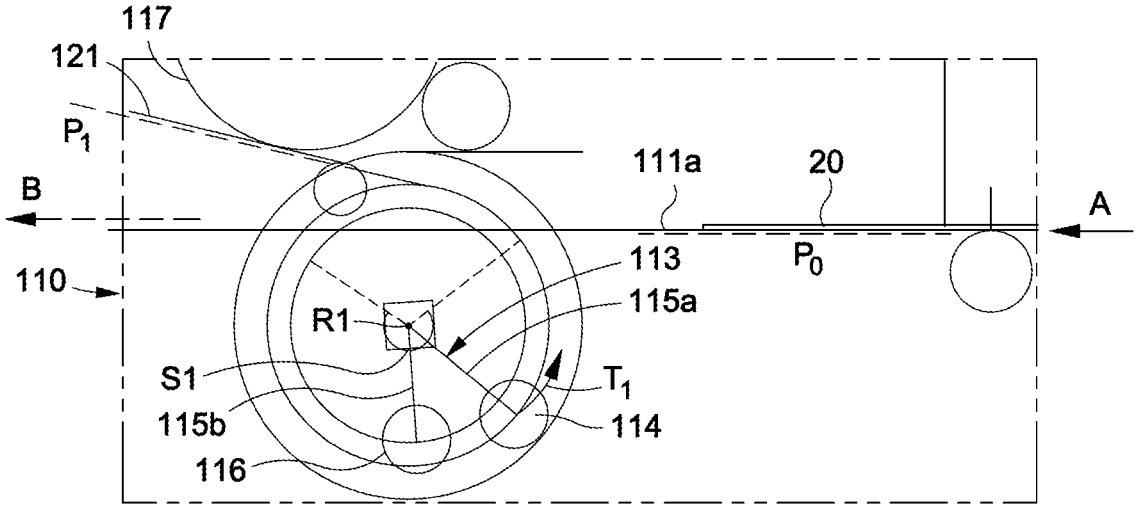
FIGS. 3 to 8 show various steps in the operation of the sampling device.

The sampling device 110 comprises firstly transport means in the form of a one or more supports 112 on which is or are mounted one or more respective transport belts 111. To support the sheet element 20 across its width the sampling device 110 consists of a plurality parallel of supports 112 disposed side by side. In the embodiment, four supports 112 support four respective transport belts 111 (FIG. 2). Each of the supports 112 comprises an upstream upper pulley 102 situated at the entry 101, a downstream upper pulley at the outlet 103, a drive pulley and idler pulleys (not visible).

The transport belts 111 are driven in the upstream-downstream direction. Each transport belt 111 has a substantially horizontal upper portion 111*a* situated and retained between the upstream upper pulley 102 and the downstream upper pulley 103. The upper portion 111*a* defines a transport plane P0. The transport belts 111 are adapted to move the successive sheet elements 20 longitudinally upstream to downstream (arrow A), the sheet elements 20 being disposed flat on the transport belt 111.

When in the active position the sampling device 110 enables a sheet element 20 advancing on the upper portion 111*a* of the transport belt 111 to rise up an evacuation ramp 121 of the evacuation device 120 (FIG. 1). This evacuation ramp 121 preferably also includes a transfer band in the form of an endless belt for movement of the sheet element reaching this evacuation ramp 121 from upstream to downstream and thus its disengagement from the upper portion 111*a* of the transport belt 111.

The sampling device 110 includes a shaft 118 situated at the level of, passing through and crossing the transport means 111 and 112, substantially toward the front of the transport means 111 and 112, below the upper portion 111*a* of the transport belt 111, and extending transversely and horizontally. The shaft 118 defines a rotation axis R1.

The sampling device 110 includes a diversion part 113 mounted on the shaft 118 to rotate about the axis R1. In the embodiment, four diversion parts 113 are disposed along the four supports 112 so as to be offset laterally relative to each of the four transport belts 111 (FIG. 2).

The diversion part 113 has at least one end 114 opposite the axis R1. The end 114 is placed at the level of a free end of an arm 115*a*. The other end of the arm 115*a* is secured to the body of the diversion part 113. The end 114 is for example equipped with an idler roller.

When the diversion part 113 rotates through a first angular sector S1, the horizontal projection of the end 114 remains below the plane P0 and below the upper portion 111*a* of the transport belt 111. When the diversion part 113 rotates through a second angular sector S2 which is complementary to the first angular sector S1 the horizontal projection of the end 114 moves above the plane P0 and therefore projects above the upper portion 111*a* of the transport belt 111. In this way a sheet element 20 is diverted in a direction and a plane P1 different from the plane P0 which therefore makes it possible to sample the sheet element 20. The plane P1 is situated above the plane P0, the upward diversion being effected by the rotation of the diversion part 113 in order not to spoil the sheet elements 20 printed on their upper face.

In the embodiment shown the support 112 is fixed but this support 112 being mobile can be envisaged, notably articulated between a plurality of positions, notably to change its inclination, for example as a function of the position of the diversion part 113.

The subsequent steps are executed in the manner FIGS. 3 to 8 show. In a step I the end 114 is at the bottom in an inactive position of the sampling device 110. The diversion part 113 turns in the anticlockwise direction (arrow T1). The end 114 reaches the height of the upper portion 111*a* of the transport belt 111 (see FIG. 3).

In a step II, the diversion part 113 turns, here still in the anticlockwise direction (arrow T2). The end 114 comes into contact the lower face of a front zone of a sheet element 20 (see FIG. 4) when the horizontal projection of the end 114 moves above the transport belt 111 and therefore the upper portion 111*a* of the transport belt 111. The diversion part 113 then stops turning (arrow T3) and the end 114 accompanies the advance movement of the sheet element 20 in the upstream-downstream direction A with a support. The sheet element 20 is therefore inclined upward in the plane P1 at the level of its front zone and moves onto the evacuation ramp 121 of the evacuation device 120 (FIG. 5).

In a step III the diversion part 113 stops rotating (see FIG. 6) while the sheet element 20 advances on the evacuation ramp 121, the end 114 supports and accompanies the advance movement of the sheet element 20 thanks also to the idler roller. This corresponds to the active position of the sampling device 110.

Figure 8:
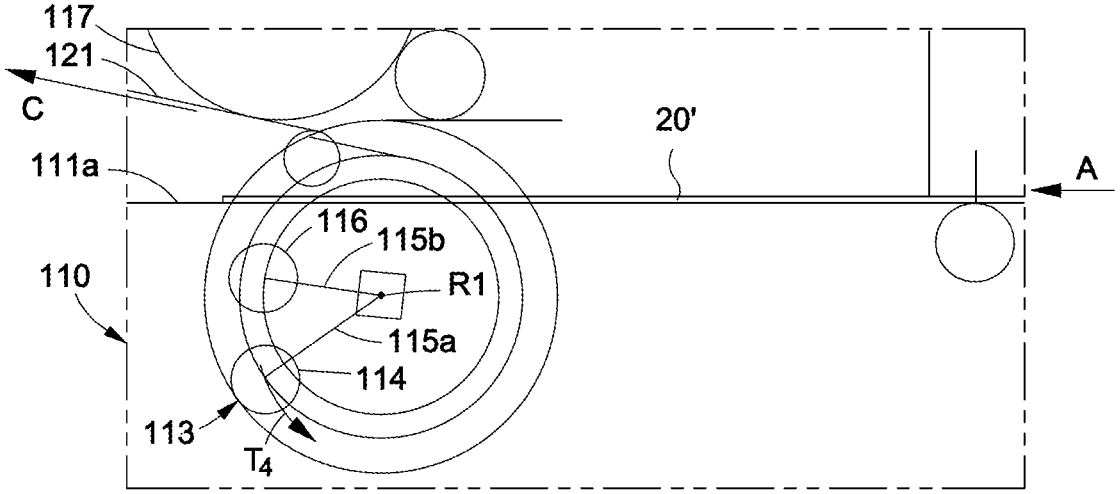

In a step IV the rear zone of the sheet element 20 passes over the end 114 and the diversion part 113 begins to rotate again (arrow T4 in FIG. 7) and descends while the sheet element 20 advances on the evacuation ramp 121, the horizontal projection of the end 114 becoming lower than the transport belt 111 before another cut-out 20' comes vertically into line with the end 114 (see FIG. 8).

In a variant shown in the figures, the diversion part 113 has at least one second end 116. The second end 116 is placed at the level of a free end of a second arm 115*b*. The other end of the arm 115*b* is secured to the body of the diversion part 113. The second end 116 is for example equipped with an idler roller. The second end 116 can be situated to the rear of the end 114 relative to the direction of rotation of the diversion part 113.

The distance between the axis R1 and the second end 116 is smaller than the distance between the axis R1 and the end 114. In other words the arm 115*a* is longer than the second arm 115*b*. When the diversion part 113 rotates with the arm 115*a* and the second arm 115*b* toward the active position of the sampling device 110 the end 114 and the second end 116 remain in contact with a sheet element 20.

In the active position of the sampling device 110 (FIGS. 6 and 7), in which the arm 115*a* and the second arm 115*b* are directed upward, the top of the second end 116 is lower than the top of the end 114.

The following steps are executed. In a step I' the end 114 and the second end 116 are at the bottom in an inactive position of the sampling device 110, the diversion part 113 with the arm 115*a* and the second arm 115 turn together (T1) and the end 114 reaches the height of the upper portion 111*a* of the transport belt 111 (see FIG. 3).

Figure 4:
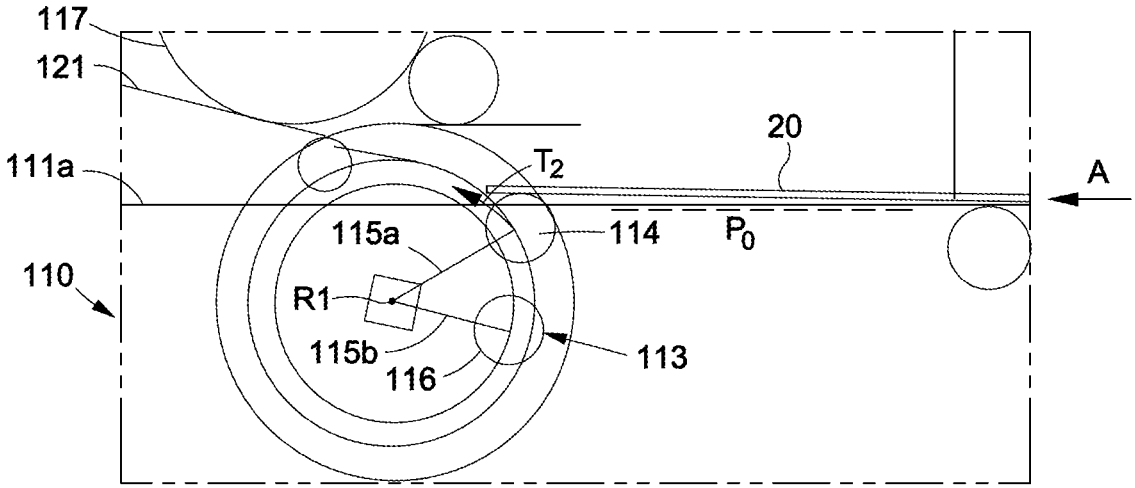
Figure 5:
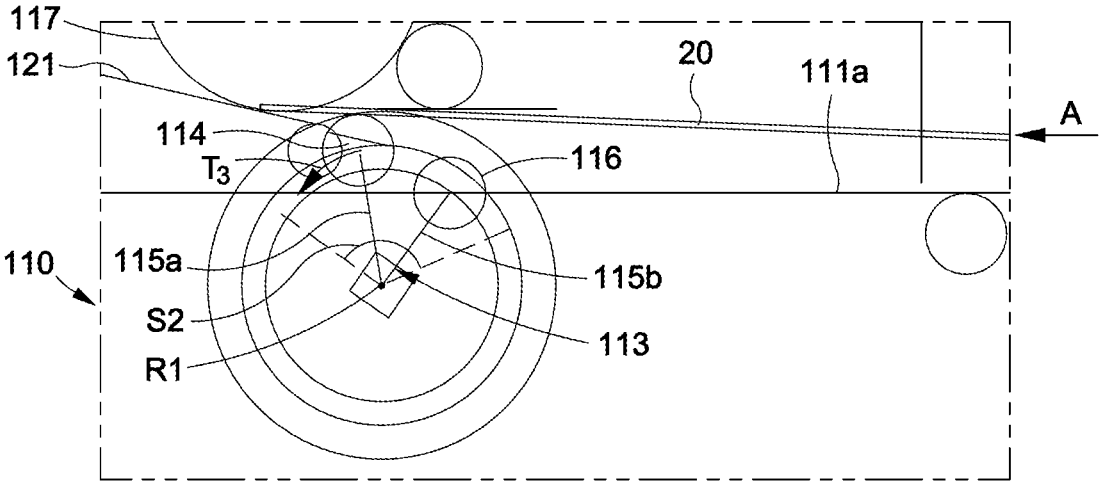
Figure 6:
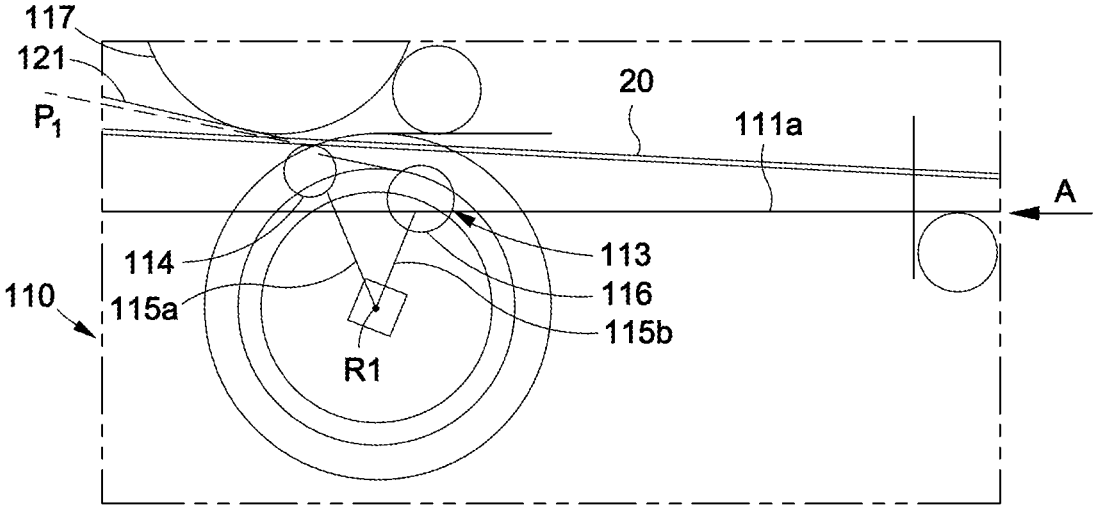
Figure 7:
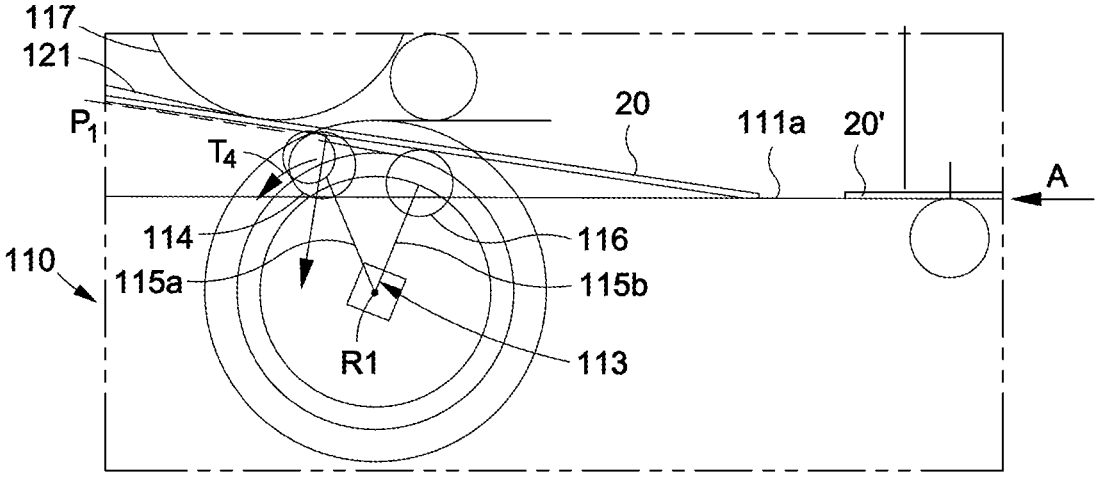

In a step II' the diversion part 113, the arm 115*a* and the second arm 115*b* continue to turn in the anticlockwise (T2 in FIG. 4). The end 114 comes into contact with the lower face of a front zone of a sheet element 20 (see FIG. 5) at the moment when the horizontal projection of the end 114 moves above the transport belt 111 and therefore the upper portion 111*a* of the transport belt 111. The diversion part 113, the arm 115*a* and the second arm 115*b* then turn further (T3) and the end 114 accompanies the advance movement of the sheet element 20 in the upstream-downstream direction (A) with a support. The sheet element 20 is inclined upward at the level of its front end in the plane P1 and moves onto the evacuation ramp 121 of the evacuation device 120 (see FIG. 6).

In a step III' the diversion part 113, the arm 115*a* and the second arm 115*b* stop rotating while the sheet element 20 advances on the evacuation ramp 121. The end 114 supports and accompanies the advance movement of the sheet element 20 by rotation of the idler roller until the sheet element 20 tilts and also comes into contact with the second end 116. The second end 116 then likewise accompanies the advance movement of the sheet element 20 by rotation of the idler roller. This corresponds to the active position of the sampling device 110.

In a step IV' the rear portion of the sheet element 20 passes over the end 114 and the diversion part 113 begins to rotate again (T4 in FIG. 7) and descends while the sheet element 20 advances on the evacuation ramp 121, the horizontal projection of the end 114 and the horizontal projection of the second end 116 then being lower than the transport belt 111 before another cut-out 20' comes into vertical alignment with the second end 116 (see FIG. 8).

The sheet element 20 is first raised by the end 114, on which it tilts before coming to bear on the second end 116. Thanks to the presence of this second end 116 the sheet element 20 is supported along two transverse lines. Each transverse line is formed by points of contact on the ends 114, respectively the second ends 116, where applicable on the respective idler rollers.

This makes it possible to avoid the tendency of the sheet element 20 to bend around the series of ends 114 if the sheet element 20 is not rigid or not very rigid. The angle between the arm 115*a* and the second arm 115*b* is preferably less than 60° and is of the order of 45°.

In one embodiment one or more pressure rollers 117 are disposed above the evacuation ramp 121 in order to contribute to guiding the sheet elements 20 on the evacuation ramp 121. In order not to press on a printed zone of the sheet elements 20 these pressure rollers 117 are placed in vertical alignment with a lateral edge of the sheet elements 20. In another embodiment that is not shown no pressure rollers are used.

In the embodiment shown the evacuation device 120 is a device for diverting one or more sheet elements 20 onto a sampling table 122.

In this embodiment a sheet element 20 serving as a sample therefore passes over an upstream section of the upper portion 111*a* of the transport belt 111 (plane P0), over the end 114 (and where applicable over the second end 116), over the evacuation ramp 121 (C and P1), and finally onto the sampling table 122.

When this sheet element 20 arrives on the sampling table 122 it is no longer driven and remains in an immobile position. The sheet element 20 can be picked up by an operative. The sheet element 20 can be picked up by an automated system and placed in an inspection station equipped with optical means for checking the quality of the printing that has been done. The optical inspection can be carried out directly on the sampling table 122.

For most of the sheet elements the sampling device 110 is in the inactive position. In this case the sheet element 20 is advanced from the rear entry end 101 to the front end of the upper portion 111*a* of the transport belt 111 by the looped movement of the transport belt 111. In this case, after leaving the sampling device 110, the sheet element 20 arrives (B) on the outlet conveyor 130.

If the operative wishes or programs the sampling device 110 to divert one or more sheet elements 20 by way of samples, the motor that drives the rotation of the shaft 118 and the diversion part 113 in accordance with a cycle conforming to the steps A to D described above is controlled manually or automatically.

Thus the invention concerns a method of sampling and of diverting the path of a sheet element 20 at the outlet of a processing machine 1 in a sorting unit 100. The method includes the following steps:

continuous movement of a sheet element 20 disposed flat in a transport plane P0 on a transport belt 111 mobile between upstream and downstream A, bringing the lower face of the front zone of the sheet element 20 into contact with so as to be supported, while the sheet element 20 advances on the transport belt 111 and following the rotation T1, T2 and T3 of the diversion part 113 about an axis R1 orthogonal to the upstream-downstream direction, by an end 114 projecting outside the plane P0, which enables the front end of the sheet element 20 to be inclined upwards, then stopping the rotation of the diversion part 113 and engaging the front zone of the sheet element 20 on an evacuation ramp 121 of the evacuation device 120 by movement of the transport belt 111 until the rear portion of the sheet element 20 passes C over the end 114, then resuming the rotation T4 of the diversion part 113 which descends while the sheet element 20 advances on the evacuation ramp 121, the horizontal projection of the end 114 then being lower than the transport belt 111 before another cut-out 20' comes into vertical alignment with the end 114.

The present invention is not limited to the embodiments described and shown. Numerous modifications may be made without this departing from the scope defined by the set of claims.

The invention claimed is:

1. A device for sampling a sheet element, the device comprising:

a first support;

a first transport belt provided on the first support, the first transport belt including an upper portion defining a plane and configured to move the sheet element longitudinally in an upstream to downstream direction;

a second support arranged side by side with the first support in a transverse direction of the upstream to downstream direction;

a second transport belt provided on the second support, the second transport belt including an upper portion defining the plane and configured to move, along with the first transport belt, the sheet element longitudinally in the upstream to downstream direction;

an axis situated below the plane, the axis extending in the transverse direction; and a diversion part rotatable about the axis, provided between the first support and the second support, and having at least one end, wherein during a rotation of the diversion part about the axis through a first angular sector, the at least one end remains below the plane, and during the rotation through a second angular sector complementary to the first angular sector, the at least one end moves above the plane to divert the sheet element in a direction different from the plane to sample the sheet element, the at least one end of the diversion part includes a first end and a second end situated to a rear of the first end relative to a direction of rotation of the diversion part, and the first end and the second end successively divert the sheet element to be sampled.

2. The device of claim 1, wherein a distance between the axis and the second end is smaller than a distance between the axis and the first end.

3. The device of claim 1, wherein angular positions of the first end and the second end enable the first end and the second end to come into contact with the sheet element.

4. The device of claim 1, wherein the diversion part further comprises a first arm having a free end including the first end and having a secured end being secured to a body of the diversion part.

5. The device of claim 4, wherein the diversion part further comprises a second arm having a free end including the second end and having a secured end being secured to the body of the diversion part.

6. The device of claim 1, wherein the first end and the second end are each equipped with a rotatable roller.

7. A sorting unit comprising:

the sampling device of claim 1;

an outlet conveyor; and an evacuation device for the sheet element, the entry of the evacuation device being disposed upstream of an entry of the outlet conveyor and above the entry of the outlet conveyor.

8. The sorting unit of claim 7, further comprising a sampling table situated downstream of the evacuation device.

9. A machine for processing the sheet element, the machine comprising:

the sorting unit as claimed in claim 8.

10. The device of claim 1, wherein the at least one end of the diversion part is provided between the first transport belt and the second transport belt in the transverse direction when the at least one end of the diversion part crosses the plane.

11. The device of claim 1, wherein the diversion part is configured to first contact the sheet element after the first transport belt and the second transport belt have moved a downstream end of the sheet element past the at least one end of the diversion part in the downstream direction.

12. A method of diverting a route of a sheet element to sample the sheet element at an outlet of a processing machine, the method comprising:

transporting, continuously in an upstream to downstream direction, a sheet element disposed in a transport plane;

rotating a diversion part about an axis transverse to the upstream to downstream direction;

bringing into contact and supporting a lower face of a front portion of the sheet element during the transport of the sheet element by an end of the diversion part projecting above the plane;

inclining the front portion of the sheet element;

stopping the rotation of the diversion part;

engaging the front portion of the sheet element on an evacuation device and transporting the sheet element until a rear portion of the sheet element passes over the end of the diversion part; and resuming the rotation of the diversion part until the end of the diversion part is below the plane before another sheet element comes into vertical alignment with the end of the diversion part.

13. A device for sampling a sheet element, the device comprising:

a first support;

a first transport belt provided on the first support, the first transport belt including an upper portion defining a plane and configured to move the sheet element longitudinally in an upstream to downstream direction;

a second support arranged side by side with the first support in a transverse direction of the upstream to downstream direction;

a second transport belt provided on the second support, the second transport belt including an upper portion defining the plane and configured to move, along with the first transport belt, the sheet element longitudinally in the upstream to downstream direction;

an axis situated below the plane, the axis extending in the transverse direction; and a diversion part rotatable about the axis, provided between the first support and the second support, and having at least one end, wherein during a rotation of the diversion part about the axis through a first angular sector, the at least one end remains below the plane, and during the rotation through a second angular sector complementary to the first angular sector, the at least one end moves above the plane to divert the sheet element in a direction different from the plane to sample the sheet element, and wherein a rotation of the diversion part about the axis from the first angular sector to the second angular sector is provided in the same rotational direction as a rotation of the diversion part about the axis from the second angular sector to the first angular sector.

14. An apparatus comprising:

at least one transport belt configured to transport a sheet element; and a diversion part including at least one rotatable roller, the diversion part configured to rotate, between an inactive position and an active position, about an axis provided below a top surface of the at least one transport belt, wherein, in the inactive position, a top surface of the at least one rotatable roller of the diversion part is below the top surface of the at least one transport belt, and, in the active position, the top surface of the at least one rotatable roller of the diversion part is above the top surface of the at least one transport belt to contact the sheet element.

15. The apparatus of claim 14, wherein the at least one transport belt includes a first transfer belt and a second transfer belt, and the diversion part is provided between the first transfer belt and the second transfer belt.

16. The apparatus of claim 14, wherein the diversion part includes a first arm and a second arm.

17. The apparatus of claim 16, wherein the at least one rotatable roller includes a first rotatable roller and a second rotatable roller, the first arm includes the first rotatable roller, and the second arm includes the second rotatable roller.

18. The apparatus of claim 17, wherein a first distance from the first rotatable roller to the axis is different from a second distance from the second rotatable roller to the axis.

19. The apparatus of claim 14, wherein a direction of rotation of the diversion part from the inactive position to the active position is the same as a direction of rotation of the diversion part from the active position to the inactive position.

* * * * *